US011499400B2

(12) United States Patent
George et al.

(10) Patent No.: US 11,499,400 B2
(45) Date of Patent: Nov. 15, 2022

(54) PUNCH MECHANISM

(71) Applicant: TORSCH INC., Calgary (CA)

(72) Inventors: Grant George, Calgary (CA); Curtis Ring, Calgary (CA)

( * ) Notice: Subject to any disclaimer, the term of this patent is extended or adjusted under 35 U.S.C. 154(b) by 0 days.

(21) Appl. No.: 15/734,538

(22) PCT Filed: Jun. 12, 2019

(86) PCT No.: PCT/CA2019/050835

§ 371 (c)(1),
(2) Date: Dec. 2, 2020

(87) PCT Pub. No.: WO2019/237202

PCT Pub. Date: Dec. 19, 2019

(65) Prior Publication Data

US 2021/0230983 A1 Jul. 29, 2021

Related U.S. Application Data

(60) Provisional application No. 62/684,129, filed on Jun. 12, 2018.

(51) Int. Cl.
*E21B 43/112* (2006.01)

(52) U.S. Cl.
CPC ..... *E21B 43/112* (2013.01)

(58) Field of Classification Search
CPC ..... E21B 43/11; E21B 43/112
See application file for complete search history.

(56) References Cited

U.S. PATENT DOCUMENTS 2,457,277 A * 12/1948 Schlumberger ..... E21B 43/112 166/55.1
6,155,150 A * 12/2000 Cooper ..... E21B 43/112 83/13
6,637,508 B2 * 10/2003 Marsh ..... E21B 43/112 166/55.2
7,712,552 B2 5/2010 In
9,284,823 B2 3/2016 Kratochivil
(Continued)

FOREIGN PATENT DOCUMENTS

GB 2412683 2/2006

OTHER PUBLICATIONS

Schlumberger Oilfield Glossary—Casing (https://glossary.oilfield.slb.com/en/terms/c/casing) Accessed 2021 (Year: 2021).*

*Primary Examiner* — David Carroll
(74) *Attorney, Agent, or Firm* — Richard D. Okimaw

(57) ABSTRACT

An apparatus for punching holes in a casing comprises an elongate casing extending between first and second ends having a plurality of punches adapted to be selectably extended therefrom, the casing having a piston cavity therein, the first end of the casing being in fluidic communication with a pressurized fluid source, a slidable piston contained within the cavity separating the cavity into extension and retraction cavities wherein the extension cavity is operable to pressurize a rear surface of the plurality of punches and the retraction cavity is operable to pressurize a front surface of the plurality of punches and a valve assembly adapted to selectably connect the pressurized fluid source with the extension or retraction cavities so as to extend or retract the punches.

16 Claims, 9 Drawing Sheets

(56) References Cited

U.S. PATENT DOCUMENTS

| | | | | |
|---|---|---|---|---|
| 2003/0070811 | A1* | 4/2003 | Robison | E21B 43/108 166/298 |
| 2015/0233217 | A1* | 8/2015 | Kratochvil | E21B 43/26 166/297 |
| 2016/0215596 | A1* | 7/2016 | Cook | E21B 43/112 |

* cited by examiner

PUNCH MECHANISM

BACKGROUND OF THE INVENTION

1. Field of Invention

The present invention relates to hydrocarbon well control in general and in particular to methods and apparatuses for selectably perforating the bore wall or tubing within a hydrocarbon well.

2. Description of Related Art

In horizontal hydrocarbon wells, it is frequently desirable to select which zone of the wellbore is to be opened for production or to stimulate one or more zones of the well to increase production of that zone from time to time. Zones may be opened prior to production, or after a production period to restore or increase production.

One current method of stimulating a zone within a well is through the use of hydraulic fracturing or fracing. In new wells, it is common practice to fracture a well in sequence from the deepest point, working towards the shallowest point. One difficulty with conventional fracing systems is that it is necessary to create or form a hole through the casing through which the fracing operation can occur. One method of opening such holes is with the use of a mechanical perforation tool, which is used to perforate the wellbore wall or casing.

Mechanical perforation devices have been developed to allow for selectable zone stimulation. However, these devices do not have the ability to be retracted and reset while remaining within the wellbore—they need to be removed and reset prior to repeated use. This is undesirable as it is time consuming. Examples of such devices are Russian Patent Nos. 2,420,656 (Ru '656) and 2,211,310 (Ru '310) and U.S. Pat. No. 8,136,584 (Burnette et al.) and U.S. Pat. No. 9,284,823 (Kratochvil et al).

A retractable perforation device has been described in UK Patent No. 2 412 683 (Marsh et al.). In order to retract the punches, the operating pressure must be reduced. With the requirement for a lower pressure to retract the punches, jamming of the device may result within the wellbore. Additionally, two sliding valves are required to accomplish the retraction function.

SUMMARY OF THE INVENTION

According to a first embodiment of the present invention there is disclosed an apparatus for forming perforations within a wellbore comprising an elongate casing extending between first and second ends, a plurality of punch members positioned radially within the elongate casing each having a first position retracted into the casing and a second position radially extended from the casing and a piston longitudinally displaceable within the casing, the piston being operable to pressurize a cavity under each of the plurality of punch members as the piston is longitudinally displaced within the casing.

The piston may be displaced by a pressurized fluid introduced to the first end of the casing. The apparatus may further include a valve fluidically located between the first end of the casing and the piston.

The valve may comprise a longitudinally slidable sleeve operable to be displaced between a first position wherein the first end and the piston are fluidically connected and a relief vent is isolated and a second position wherein the piston and the relief vent are fluidically connected and the first end of the casing is isolated. The sleeve may be movable from the first position to the second position by a predetermined pressure being provided to the first end of the casing. The predetermined pressure may be greater than the pressure required to move the plurality of punch bodies from the retracted to the extended positions.

According to a further embodiment of the present invention there is disclosed an apparatus for punching holes in a casing comprising an elongate casing extending between first and second ends having a plurality of punches adapted to be selectably extended therefrom, the casing having a piston cavity therein, the first end of the casing being in fluidic communication with a pressurized fluid source, a slidable piston contained within the cavity separating the cavity into extension and retraction cavities wherein the extension cavity is operable to pressurize a rear surface of the plurality of punches and the retraction cavity is operable to pressurize a front surface of the plurality of punches and a valve assembly adapted to selectably connect the pressurized fluid source with the extension or retraction cavities so as to extend or retract the punches.

The valve assembly may comprise a longitudinally slidable sleeve located within a valve cavity of the casing between first and second positions wherein the first position connects a fluid input path to a first output extending to the extension cavity and the second connects the fluid input channel to a second output path extending to the retraction cavity.

The sleeve may be biased to the first position. The sleeve may be biased to the first position by a spring. The sleeve may form an annular directing cavity with the valve cavity. The sleeve may include first and second annular walls extending to a sealed contact with the valve cavity defining the directing cavity therebetween. The first annular wall may have a greater height and the second annular wall so as to bias the sleeve towards the second position under pressure from the fluid source.

The directing cavity may be in fluidic communication with a fluid input extending to the first end of the casing. The directing cavity may be selectably in fluidic communication with the extension cavity at the first position of the sleeve with the retraction cavity at the second position of the sleeve. The sleeve may include flexible fingers extending therefrom adapted to be selectably engageable within annular detents in the valve cavity at the first and second positions.

The sleeve may form a vent chamber with the valve chamber. The vent chamber may be vented to an exterior of the casing. The vent chamber may be selectably in fluidic communication with an opposite of the first or second flow paths that is in communication with the fluid input.

The piston may be selectably retained at an initial position towards the extension cavity when the plurality of punches are retracted. The piston may be retained at the initial position by biased arms selectably engaged within an annular groove. The piston may form a second piston extension chamber with the casing separate from the extension chamber wherein the extension chamber is vented to an exterior of the casing as the piston is moved in a direction of the extension chamber.

The pressurized fluid may be directed through a mandrel extending through the piston to the front surfaces of the plurality of punches at the second position of the sleeve. The plurality of punches may extend and retract along radial paths from the casing. The plurality of punches may be contained within the casing at a retracted position.

According to a further embodiment of the present invention there is disclosed a method of punching holes in a casing comprising locating an elongate casing within a wellbore at a desired location, the elongate casing extending between first and second ends having a plurality of punches adapted to be selectably extended therefrom, the casing having a piston cavity therein, pressurizing a first end of the elongate casing with a pressurized fluid source and directing the pressurized fluid to an extension side of a piston located within the cavity with a valve assembly adapted to selectably connect the pressurized fluid source with the extension or retraction cavities so as to extend or retract the punches.

Other aspects and features of the present invention will become apparent to those ordinarily skilled in the art upon review of the following description of specific embodiments of the invention in conjunction with the accompanying figures.

BRIEF DESCRIPTION OF THE DRAWINGS

In drawings which illustrate embodiments of the invention wherein similar characters of reference denote corresponding parts in each view.

DETAILED DESCRIPTION

Figure 1:
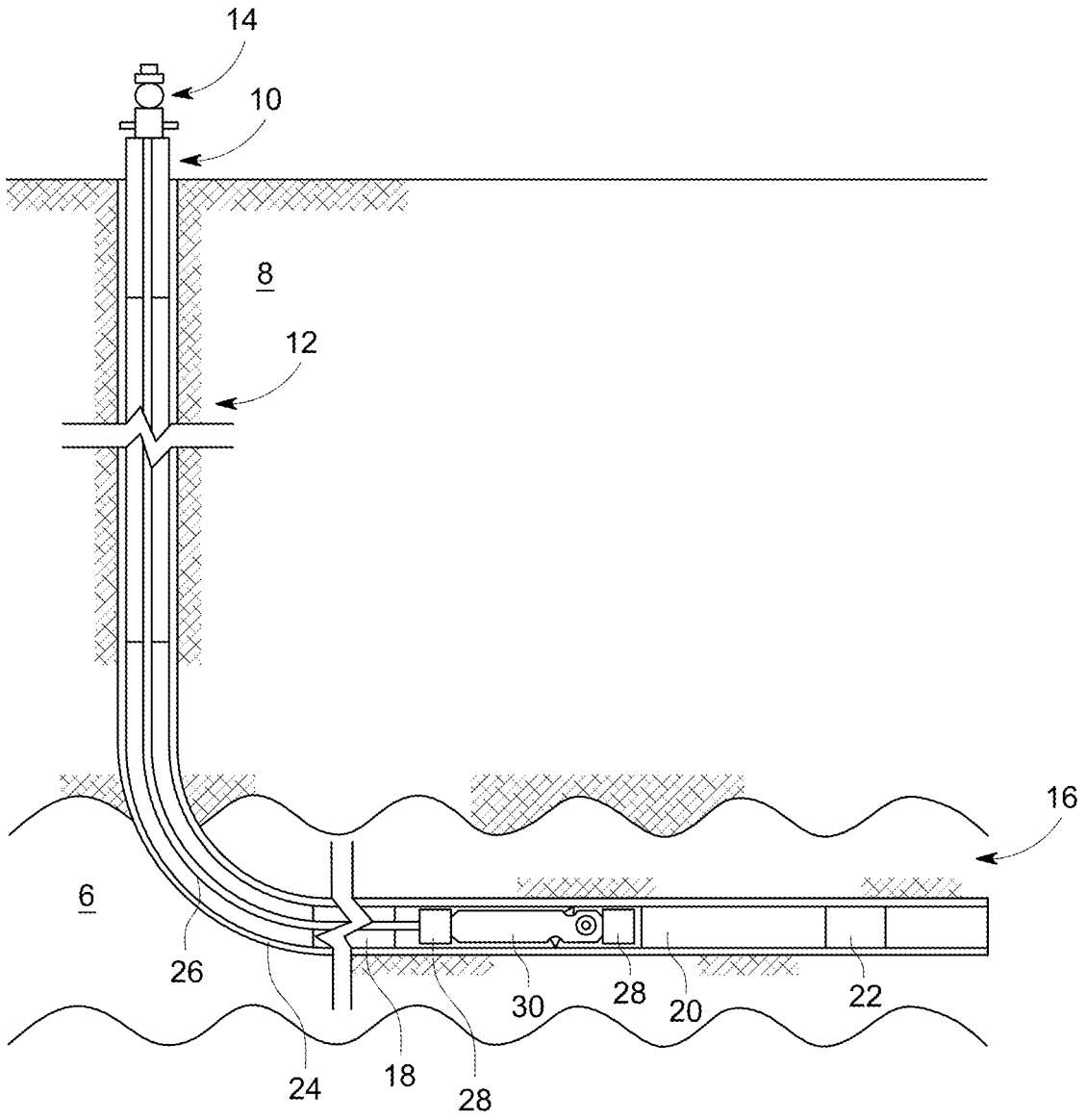
FIG. 1 is a cross-sectional view of a wellbore having a punch mechanism according to the first embodiment of the invention.

Referring to FIG. 1, a wellbore 10 is drilled into the ground 8 to a production zone 6 by known methods. The production zone 6 may contain a horizontally extending hydrocarbon bearing rock formation or may span a plurality of hydrocarbon bearing rock formations such that the wellbore 10 has a path designed to cross or intersect each formation. As illustrated in FIG. 1, the wellbore includes a vertical section 12 having a valve assembly or Christmas tree 14 at a top end thereof and a bottom or production section 16 which may be vertical, horizontal or angularly oriented relative to the horizontal located within the production zone 6. After the wellbore 10 is drilled, the production tubing 18 is located therein and optionally surrounded by a layer of cement 24 between the casing and the wellbore. In order to perform a hydraulic fracturing or fracing operation, a work string 26 may be lowered into the production tubing 18 with a punch mechanism generally indicated at 30 thereon.

Figure 2:
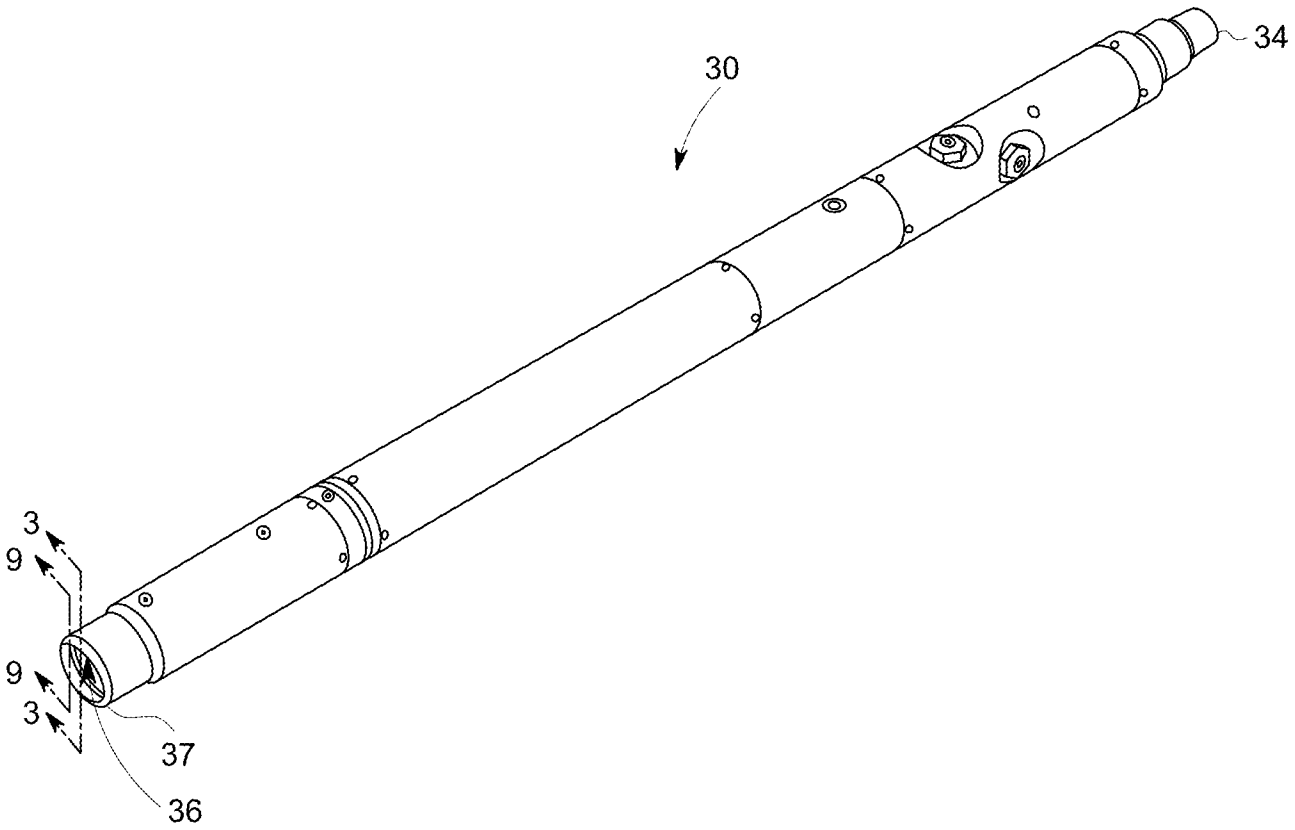
FIG. 2 is a is a perspective view of the punch mechanism of FIG. 1.
Figure 3:
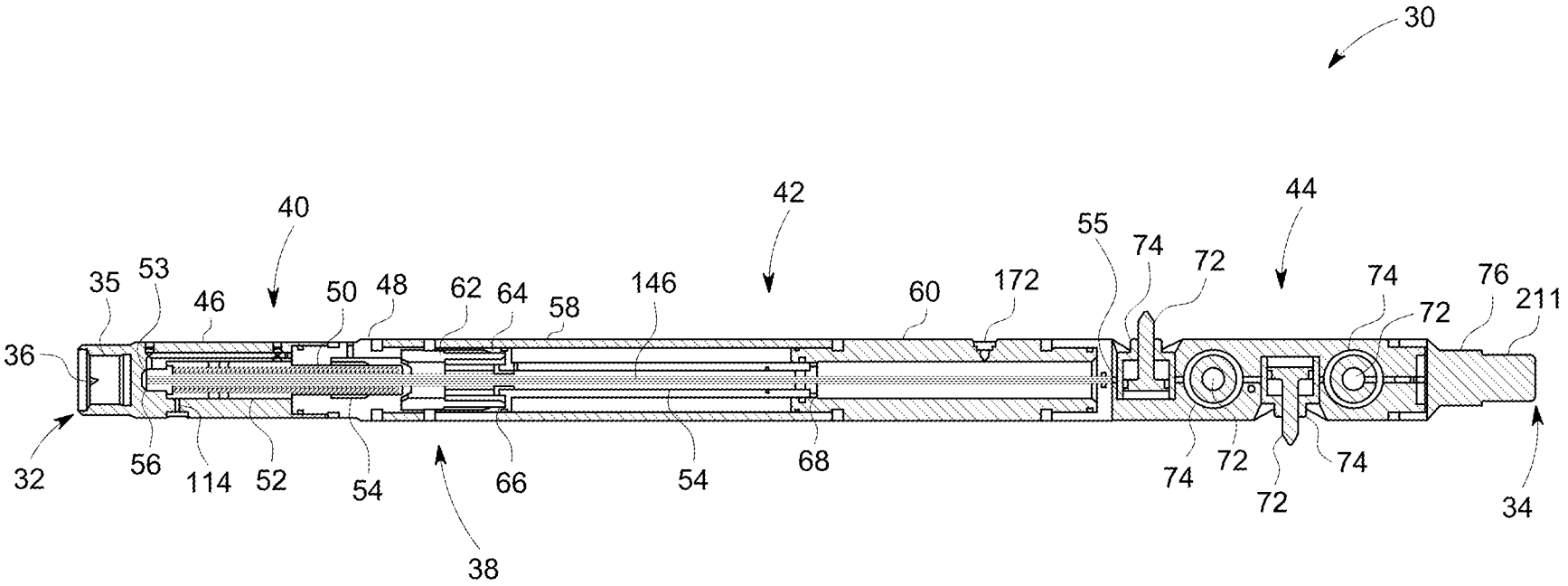
FIG. 3 is a longitudinal cross-sectional view of the punch mechanism of FIG. 2 taken along the line 3-3 in the first retracted position.
Figure 4:
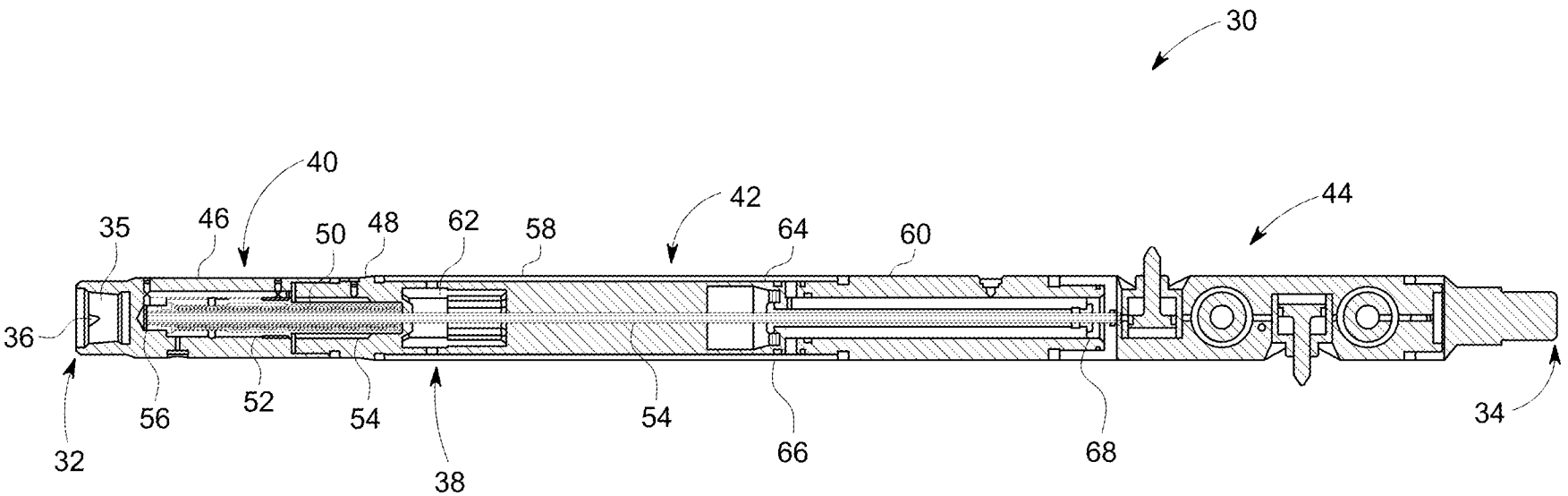
FIG. 4 is a longitudinal cross-sectional view of the punch mechanism of FIG. 2 taken along the line 3-3 in the second extended position.

Turning now to FIG. 2, a perspective view of a punch mechanism 30 according to a first embodiment of the present invention is illustrated. The punch mechanism 30 comprises a substantially elongate cylindrical body extending between first and second ends, 32 and 34, respectively. Referring to FIGS. 3 and 4, the punch mechanism 30 is comprised of a control valve section 40 proximate to the first end 32, a punch section 44 proximate to the second end 34, and a piston section 42 therebetween. The control valve section 40 utilizes fluid pressure to shift a sliding piston 64 within the piston section 42 thereby extending or retracting a plurality of punches 72 within the punch section 44, as will be described in more detail below.

Figure 5:
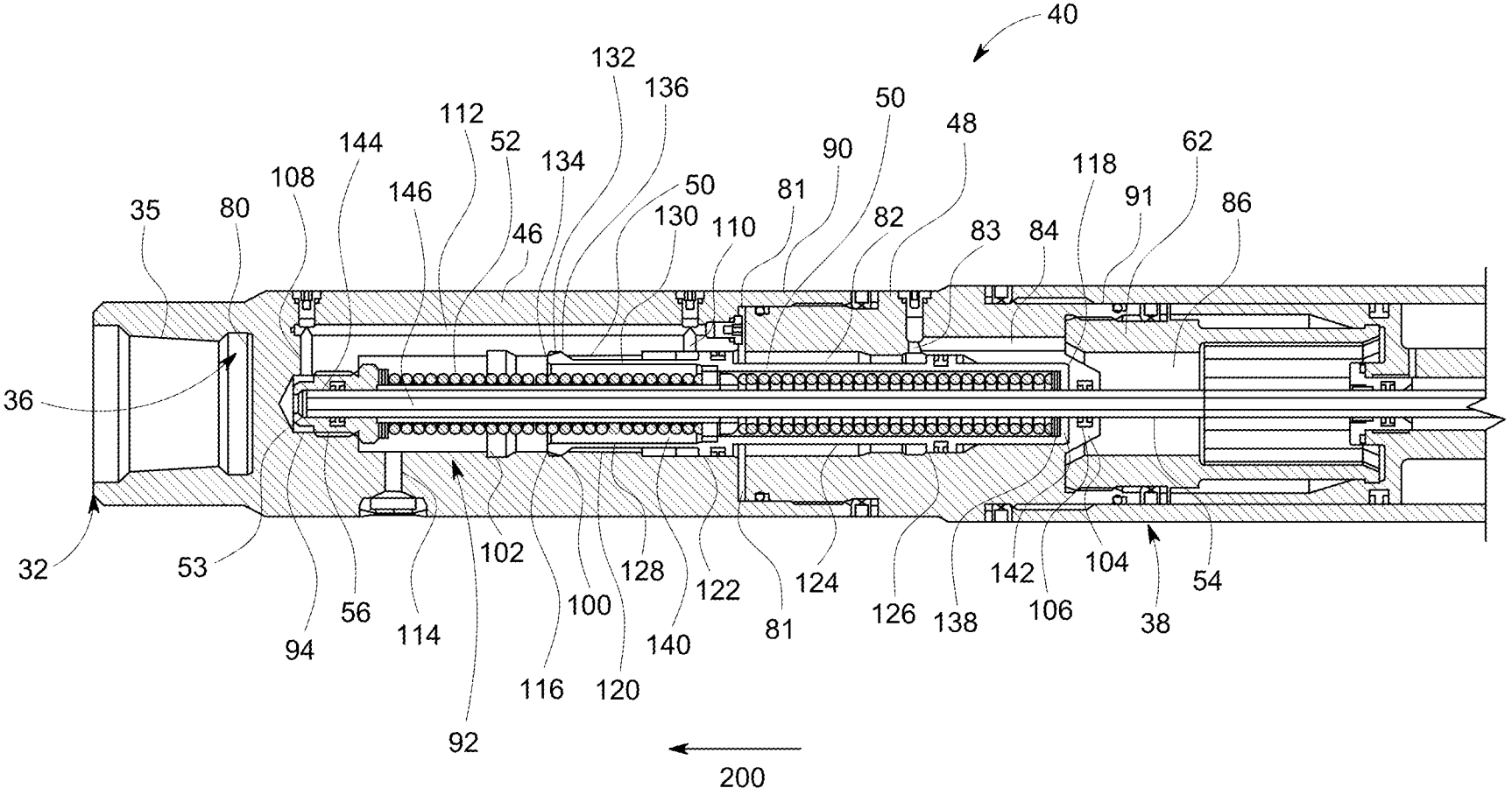
FIG. 5 is a longitudinal cross-sectional view of the control valve section of the punch mechanism of FIG. 2 taken along the line 3-3 in the first retracted position.

As best seen in FIG. 5, the control valve section 40 comprises a body extending between the first end 32 of the punch mechanism 30 and a second end 38, and may be formed as first and second control valve body portions 46 and 48, respectively, having an axial central cavity 92 extending therethrough, containing a shifting sleeve 50 and a central mandrel 54 therein, as will be described in more detail below. The first end 32 of the punch mechanism 30 is connected to a tool or sensor 28 within the work string 26 by internal threading 35 at the first end 32, as is commonly known. The shifting sleeve 50 shifts within the control valve section 40 to alter the flow of fluid therethrough to extend and retract the punches as will be more fully explained below.

Referring to FIG. 5, the first control valve body portion 46 is substantially cylindrical and mated with the second control valve body portion 48 such as with a cylindrical extension 90 at the distal end thereof. The second control valve body portion 48 is substantially cylindrical and includes a release collet 62 extending therefrom, as will be described in more detail below. The first and second control valve body portions 46 and 48 form an annular cavity 81 therebetween and extending from an axial bore 80 (shown in FIG. 9), as will be described more fully below. It will also be appreciated that the first and second control valve body portions 46 and 48 may be co-formed with the annular cavity 81 formed therein. A plurality of passages are bored or otherwise formed axially and radially through the first and second control valve body portions 46 and 48, the purpose of which will be described in more detail below. As set out above, central cavity 92 extends through the control valve section 40 containing a shifting sleeve 50 therein. The central mandrel 54 extends through the central cavity 92 within the shifting sleeve 50, the purpose of which will be described in more detail below. The central cavity 92 may include a narrow end portion 94 proximate to the first end 32, sized to contain an optional mandrel cap 56 therein. The surface of the central cavity 92 includes first and second annular recesses, 100 and 102, respectively, thereon, the purpose of which will be described more fully below.

Figure 8:
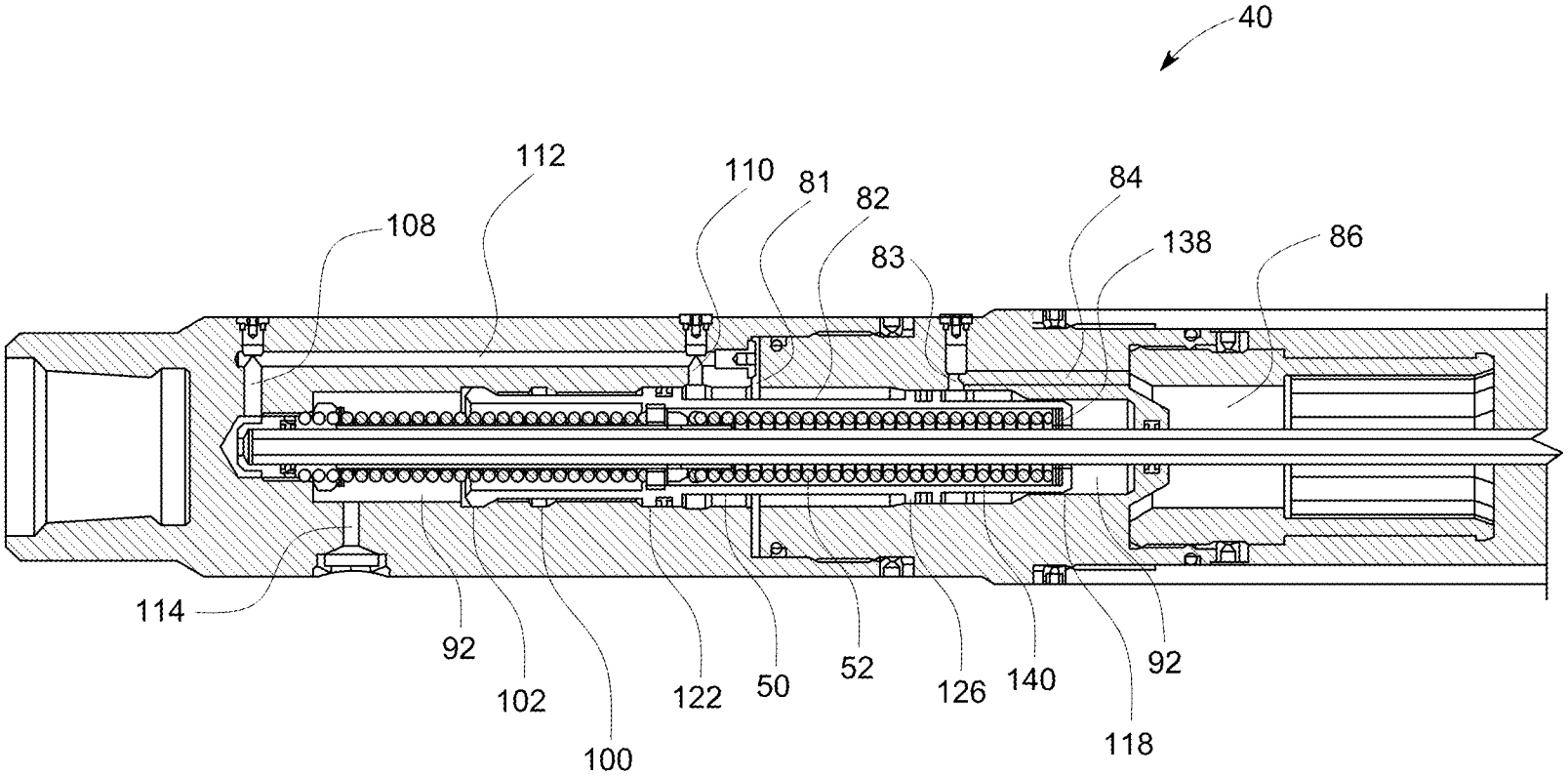
FIG. 8 is a longitudinal cross-sectional view of the control valve section of the punch mechanism of FIG. 2 taken along the line 3-3 in the second shifted position.

The shifting sleeve 50 comprises a substantially elongate tubular body extending between first and second ends, 116 and 118, respectively, with an internal cavity 140 therein. A collet portion 120 extends between the first end 116 and a first external raised annular ridge 122 and engages upon the surface of the central cavity 92. A second portion 124 extends between the first external raised annular ridge 122 and the second end 118, with a second external raised annular ridge 126 at a midpoint therealong. The first and second external raised annular ridges, 122 and 126, respectively, engage upon the surface of the central cavity 92 with seals, as are commonly known, therearound, the purpose of which will be described in more detail below. A plurality of axial slots 128 extend radially through the collet portion 120, forming a plurality of collet arms 130, each having external raised sections 132 defined by tapers 134 and 136 at the first end 116 thereof. The outer diameter of the raised section 132 is sized to fit within the first and second position stops, as defined by first and second annular recesses 100 and 102 positioned on the surface of the central cavity 92. The shifting sleeve 50 may be slidably positioned between the first and second position such that the raised sections 132 are located within the first and second annular recesses 100 and 102, as will be described in more detail below. The second end 118 includes an internal annular wall 142 with a central bore 138 therethrough, sized larger than the central mandrel 54 diameter to allow fluid to pass therebetween, fluidically connecting the central cavity 92 proximate to the second end 118 with the internal cavity 140 when in the second shifted position, as seen in FIG. 8.

The optional mandrel cap 56 includes a central axial bore 144 therethrough sized to fit the central mandrel 54 therein, including a seal, as is commonly known, between the exterior of the central mandrel 54 and the interior of the mandrel cap 56, providing a barrier between the central cavity 92 and the narrow end portion 94. As best seen on FIG. 3, the central mandrel 54 comprises a substantially cylindrical elongate body, extending between first and second ends 53 and 55, respectively, with a central mandrel passage 146 therethrough. Referring now to FIG. 5, the central mandrel passage 146 is in fluidic communication with the narrow end portion 94 through the central axial bore 144 of the mandrel cap 56. The narrow end portion 94 is in fluidic communication with a radial bore 108, the purpose of which will be described in more detail below. It may be appreciated that the mandrel cap 56, as illustrated in the present embodiment of the invention, is optional, the purpose being to separate the central cavity 92 from the passages connected to the narrow end portion 94, as will be described in more detail below. It may be appreciated that other sealing methods, as are commonly known, may be used as well.

A compression spring 52 extends between the mandrel cap 56 and the second end 118 of the shifting sleeve 50 and is sized to fit therein, allowing fluid to pass therearound. Although two compression springs 52 are illustrated in the present embodiment of the invention, it may be appreciated that more or less springs may be useful, as well. FIGS. 3, 4, 5 and 9 illustrate the compression spring 52 is in the relaxed, extended position, whereas FIG. 8 illustrates the compression spring 52 in the compressed position. Operation of the compression spring 52 will be explained in more detail below.

Figure 9:
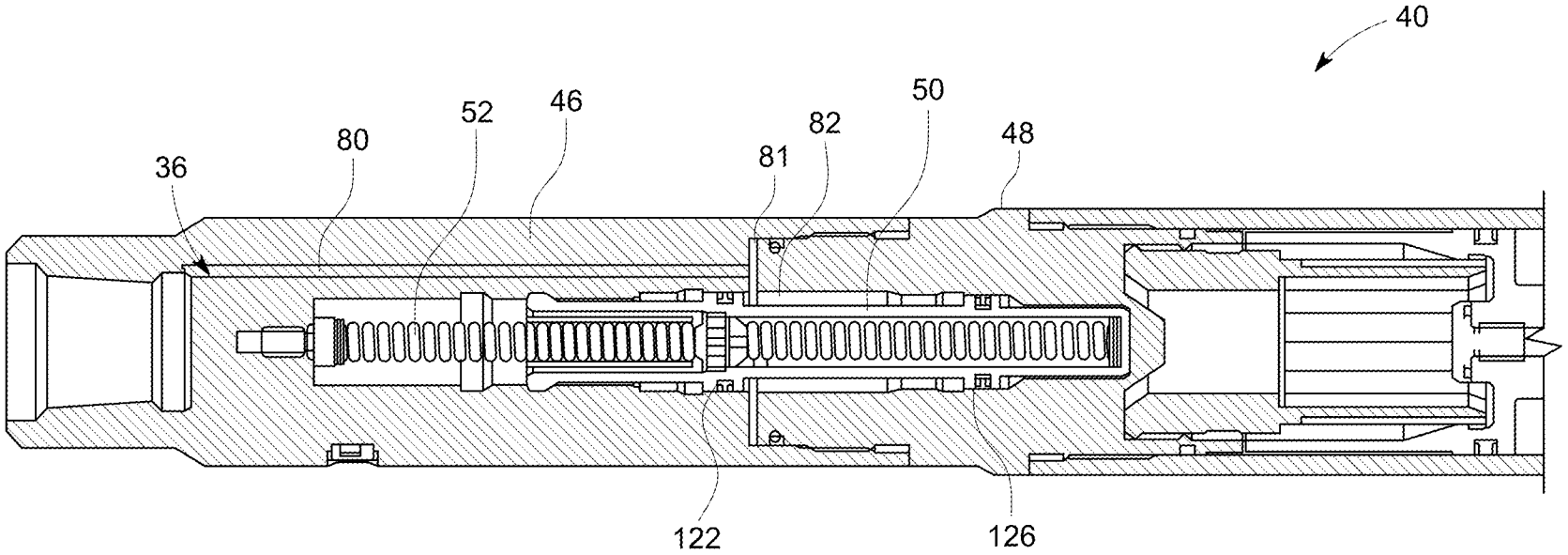
FIG. 9 is a longitudinal cross-sectional view of the control valve section of the punch mechanism of FIG. 2 taken along the line 9-9 in the first retracted position.

Turning now to FIGS. 5 and 9, an axial bore 80 in the first control valve body portion 46 fluidly connects with the annular cavity 81 to an annular directing cavity 82 formed between the first and second control valve body portions 46 and 48, respectively. As illustrated, the first and second external raised annular ridges, 122 and 126, of the shifting sleeve 50 are located to span the annular cavity 81 and define an annular directing cavity 82 therebetween. The axial bore 80 is best seen in FIG. 9. Referring to FIG. 5, when the shifting sleeve 50 is in the first position, the annular directing cavity 82 fluidly connects with an annular piston extension cavity 86 through a radial bore 83 and an axial bore 84 through the second control valve body portion 48 to the piston section 42. Proximate to the second end 38 of the control valve section 40, the second control valve body portion 48 includes an end wall 104 separating the central cavity 92 from the annular piston extension cavity 86, with a central axial bore 106 therethrough sized to receive the central mandrel 54 with a seal therebetween, as is commonly known.

In the first position, as shown in FIG. 5, radial bores 108 and 110 extend from the central cavity 92 and connect with an axial bore 112 extending therebetween, so as to fluidically connect the central cavity 92 with the narrow end portion 94, the purpose of which will be described in more detail below. In the second shifted position, as shown in FIG. 8, radial bore 110 connects with the annular directing cavity 82 while radial bore 83 connects with the central cavity 92, the purpose of which will be described in more detail below. A radial bore 114 extends from the central cavity 92 to the exterior of the first control valve body portion 46, allowing fluidic communication with the production section 16 so as to permit the contents of the central cavity 92 to be vented to the wall annulus. As illustrated in the attached figures for the present embodiment of the invention, a plurality of plugs may be inserted into the plurality of bore holes for construction purposes, although it may be appreciated that the passages through the punch mechanism 30 may be formed in other ways, without the requirement for plugs.

Figure 6:
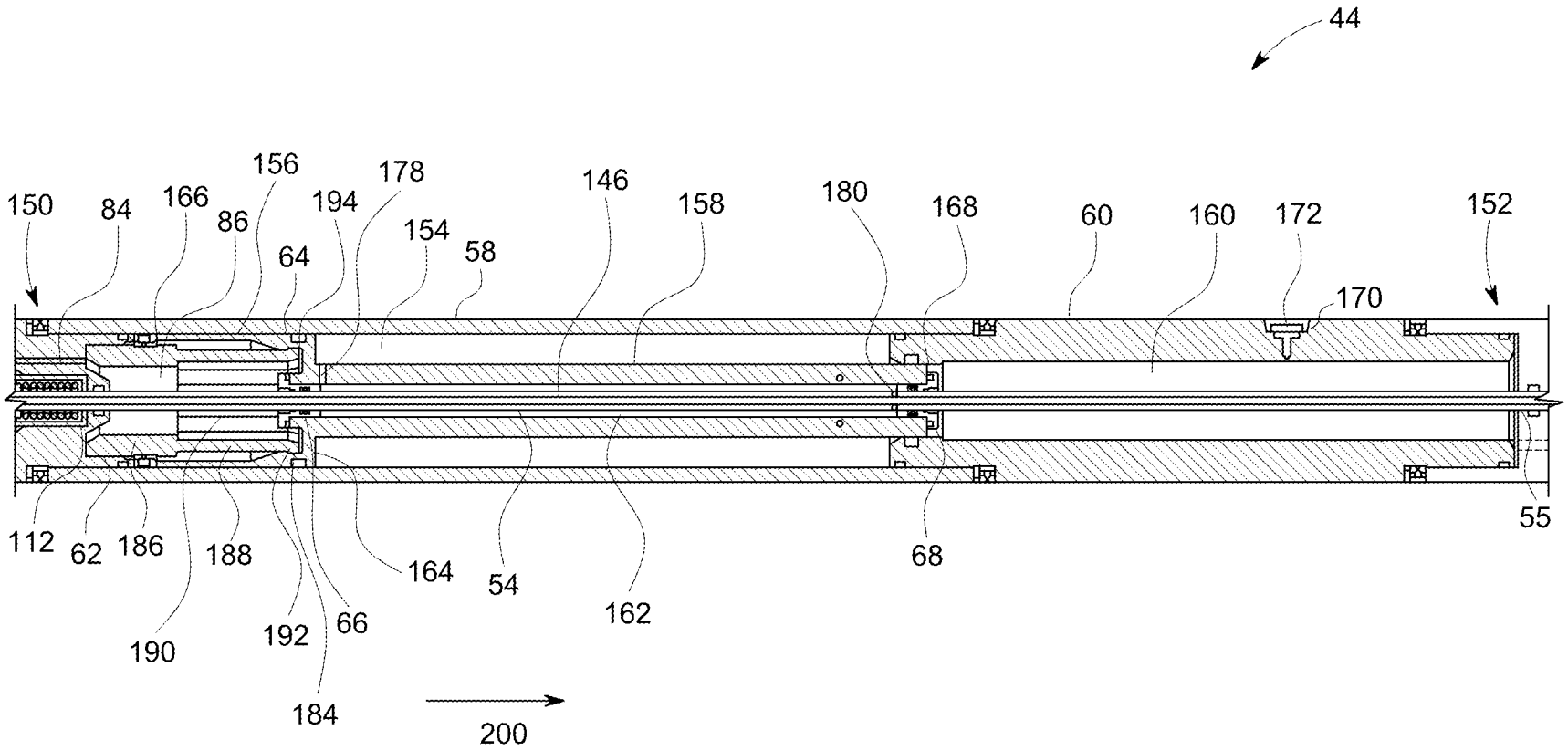
FIG. 6 is a longitudinal cross-sectional view of the piston section of the punch mechanism of FIG. 2 taken along the line 3-3 in the first retracted position.

Turning now to FIG. 6, the piston section 42 comprises a body extending between first and second ends, 150 and 152, respectively, and may be formed as an outer casing having a wide portion 58 and a narrow portion 60. The wide portion 58 extends from the control valve section 40 and the narrow portion is proximate to the punch section 44, as best seen in FIGS. 3 and 4. As illustrated, the wide and narrow portions, 58 and 60, respectively, may be formed of separate elements or may optionally be co-formed. As illustrated, the piston section 42 defines a cavity therein containing the release collet 62 and a sliding piston 64. The central mandrel 54 extends through the sliding piston 64, as will be described in more detail below. The wide portion 58 of the outer casing is secured to the control valve section 40, which may be attached by any known means. The narrow portion 60 of the outer casing proximate to the second end 152 is secured to the punch section 44 through any known means.

The sliding piston 64, extending between first and second ends, 166 and 168, respectively, comprises a wide portion 156 and a narrow portion 158. The wide portion 58 of the outer casing contains the sliding piston 64 therein defining piston extension and first piston retraction cavities, 86 and 154, respectively to opposite sides of the wide portion 156 of the sliding piston 64. The wide portion 156 and narrow portion 158 include an annular shoulder 164 therebetween. As illustrated, the wide portion 156 includes an inwardly oriented annular notch 194 to engage corresponding outwardly oriented annular catches 192 on the release collet 62 therein. The narrow portion 158 extends between the annular shoulder 164 and the second end 168. A second piston retraction cavity 160 is defined by the narrow portion 60, and is sized to receive the narrow portion 158 of the sliding piston 64 therein, with a seal, as is commonly known, therebetween, separating the first and second piston retraction cavities, 154 and 160, respectively. A port 170 extending radially between the second piston retraction cavity 160 and the outer surface of the narrow portion 158 contains a check valve 172, as is commonly known, therein, providing fluidic communication in one direction only, from the production section 16 to the second piston retraction cavity 160, the purpose of which will be described in more detail below.

An inner piston cavity 162 extends axially through the narrow portion 158 of the sliding piston 64 and is sized to receive the central mandrel 54 therethrough, with seals 66 and 68 thereon. A piston cavity relief bore 178 extends radially through the narrow portion 158 of the sliding piston 64 proximate to the annual shoulder 164 and the seal 66, providing fluidic communication between the inner piston cavity 162 and the first piston retraction cavity 154, the purpose of which will be described in more detail below. The central mandrel 54 extends through the piston section 42, extending through the inner piston cavity 162, as described above. A plurality of mandrel bores 180 extend radially through the central mandrel 54 proximate to the second seal 68 within the inner piston cavity 162, providing fluidic communication between the central mandrel passage 146 and the inner piston cavity 162, the purpose of which will be described in more detail below.

A release collet 62 comprises a substantially elongate cylindrical body extending between first and second ends, 182 and 184, respectively, with a passage therethrough, and is contained within the piston extension cavity 86 of the piston section 42. The release collet 62 is comprised of a first portion 186 proximate to the first end 182 and a second collet extension portion 188 proximate to the second end 184. Although the release collet 62 is illustrated in the present embodiment of the invention as being attached to the control valve section 40, it may be appreciated that it may be useful to connect the release collet 62 to the wide portion 58 by any known means, as well. The first portion 186 proximate to the first end 182 is secured to the second control valve body portion 48 so as to not obstruct the axial bore 84, permitting fluid flow with the piston extension cavity 86. The second collet extension portion 188 includes a plurality of axial collet arms 190 having outwardly oriented annular catches 192 sized to be received within the annular notch 194 on the inner surface of the sliding piston 64 wide portion 156 at the distal end thereof to allow the collet to release when sufficient force is applied.

Figure 7:
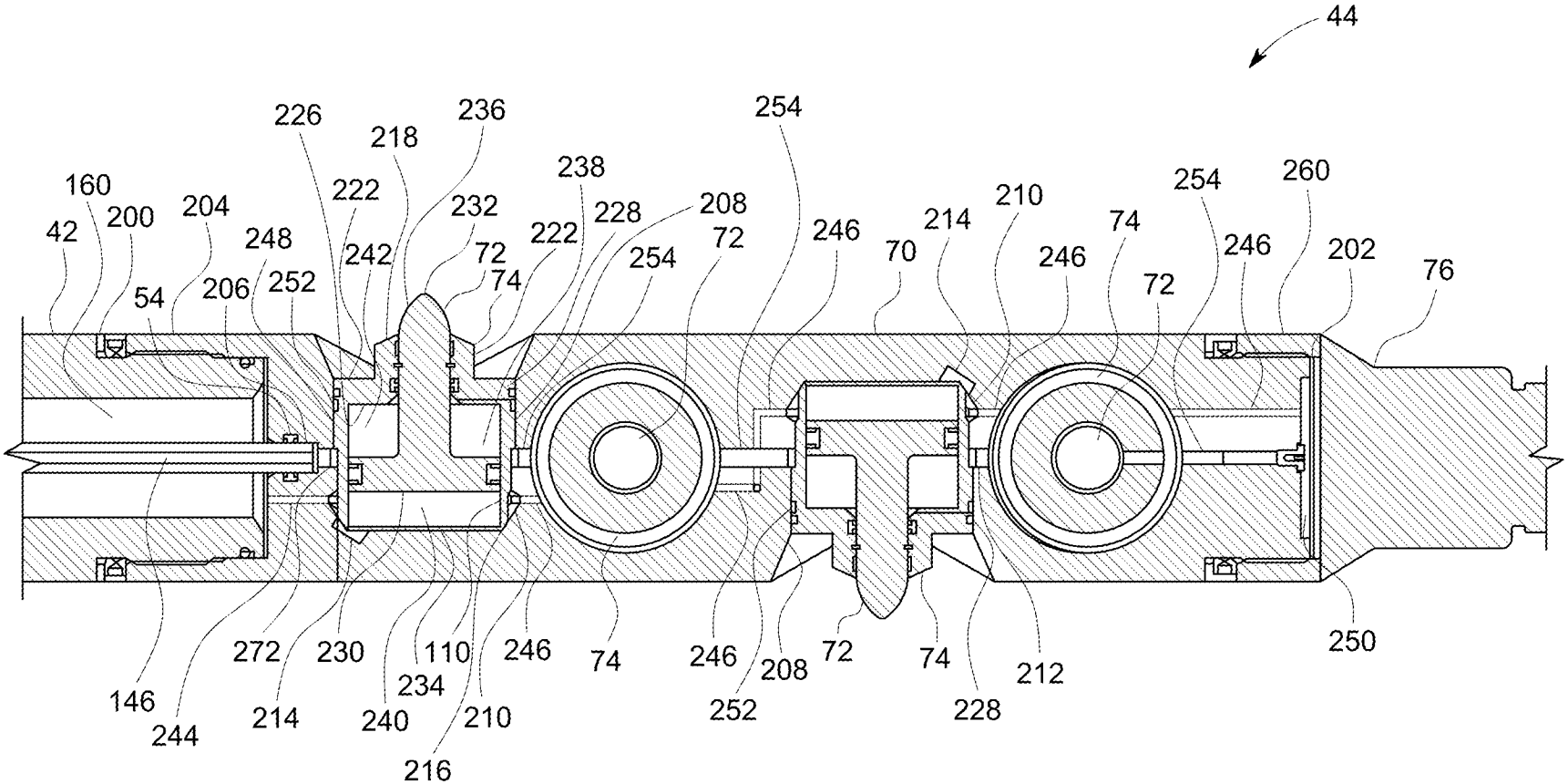
FIG. 7 is a longitudinal cross-sectional view of the punch section of the punch mechanism of FIG. 2 taken along the line 3-3 in the first retracted position.

Turning now to FIG. 7, the punch section 44 includes a punch casing 70 comprising a substantially elongate cylindrical body extending between first and second ends, 200 and 202, respectively, with a plurality of radial sockets 208 containing therein a plurality of punches and punch sleeves 72 and 74, respectively. A plurality of passages are bored or otherwise formed axially and radially through the punch casing 70, the purpose of which will be described in more detail below. The first end 200 includes a cylindrical extension 204 sized to receive the piston section 42 therein. A central axial bore 206, extending through the punch casing 70 proximate to the first end 200 through to the proximate radial socket 208, is sized to receive the central mandrel 54 therein, with seals, as are commonly known, therebetween. A cylindrical extension 260 on an end cap 76 is sized to receive the second end 202 of the punch casing 70 therein, with an axial gap therebetween, forming a cylindrical end cavity 250 therein, the purpose of which will be described in more detail below. As best seen on FIG. 3, the end cap 76 comprises a cylindrical body with external threading 211 at the second end 34, as is commonly known.

The plurality of radial sockets 208 are substantially cylindrical with internal threading, as is commonly known, and are sized to receive the plurality of punch sleeves 74 therein, mated with external threading, as is commonly known, thereon, with a plurality of annular notches 210 and 212 therearound, the purpose of which will be described in more detail below. Each radial socket 208 includes a cavity extension notch 214 intersecting with the annular notch 210, the purpose of which will be described in more detail below.

Each punch 72, extending between first and second ends, 230 and 232, respectively, comprises a wide cylindrical base portion 234 and a narrow substantially cylindrical punch portion 236 with an annular shoulder 238 therebetween. Each cylindrical punch portion 236 is tapered at the second end 232 thereof. Each substantially cylindrical punch sleeve 74, extending between first and second ends, 216 and 218, respectively, comprises a wide portion 220 with external threading thereon and a narrow portion 222, with a passage therethrough, containing a punch 72 therein with seals, as are commonly known, therebetween, defining punch extension and retraction cavities, 240 and 242, respectively, therein. Each wide portion 220, extending between the first end 216 and an external annular shoulder 224, is sized to engage upon the inner surface and threading of each radial socket 208, with seals, as are commonly known, therebetween. The inner diameter of each wide portion 220, extending between the first end 216 and an inner annular shoulder 226, is sized to receive the wide cylindrical base portion 234 of a punch 72 therein with seals, as are commonly known, therebetween A radial retraction cavity bore 228 extends through the wide portion 220 of each punch sleeve 74 proximate to the inner annular shoulder 226, providing fluidic communication between each punch retraction cavity 242 and an annular passage formed between an annular notch 252 in the wide portion 220 of the punch sleeve 74 and the surrounding radial socket 208, the purpose of which will be described in more detail below. The threading on the punch sleeve 74 and radial socket 208 may be sufficiently coarse to provide a spiral passage 248 therethrough connecting the annular notch 212 with the annular notch 252. Alternately, the threading may include a milled slot or missing section (not shown) to provide fluidic communication between the annular notch 212 and the annular notch 252. Each narrow portion 222, extending radially between the external annular shoulder 224 and the second end 218, and internally between the inner annular shoulder 226 and the second end 218, is sized to receive the cylindrical punch portion 236 of a punch 72 therein with seals, as are commonly known, therebetween. Although the present embodiment of the invention illustrates each narrow portion 222 with a narrow outer diameter, it may be appreciated that a wider outer diameter may be useful, as well.

An axial punch extension supply passage 244 extends through the punch casing 70 proximate to the first end 200 through to the annular notch 210 of the proximate radial socket 208, providing fluidic communication between the second piston retraction cavity 160 of the piston section 42 and the punch extension cavity 240 through the intersecting cavity extension notch 214. A plurality of intersecting axial and radial bores form a plurality of punch extension connection passages 246 extending between the plurality of annular notches 210 and cavity extension notches 214, providing fluidic communication between all of the punch extension cavities 240. The punch extension connection passage 246 proximate to the second end 202 connects with the cylindrical end cavity 250.

The central axial bore 206, as described above, extends to the proximate radial socket 208, intersecting an annular notch 212, thereby providing fluidic communication between the central mandrel passage 146 with the annular notch 212. The plurality of annular notches 212 and a plurality of axial passages 254 intersect to provide fluidic communication therethrough. The axial passage 254 proximate to the second end 202 is fitted with a plug, as is commonly known, so that it does not connect with the cylindrical end cavity 250As outlined above, the plurality of annular notches 212 are in fluidic communication with the plurality of annular notches 252 through coarse threading or a milled slot, thereby providing fluidic communication between the plurality of retraction cavities 242 and the central mandrel passage 146. It may be appreciated that the plurality of passages through the punch casing 70 may be arranged in other configurations to extend and retract the plurality of punches 72.

Upon installation, the punch mechanism commences in the first retracted position, as shown in FIG. 3, with fluid occupying all cavities. Working fluid enters the cavities through the first end 32 as provided by a pump connected to the tool string as is commonly known as generally indicated at 36 while external fluid may enter through radial bore 114 in the control valve section 40 and through the second piston cavity check valve 172 in the piston section 42. To operate from the first position, as illustrated in FIGS. 3 and 5, the working fluid enters the axial bore 80 to the annular cavity 81. With the shifting sleeve 50 in the first position, the annular cavity 81 is connected with the annular directing cavity 82 and permitted to exit the axial bore 84 through the radial bore 83, to the piston extension cavity 86. Referring to FIG. 6, when the working fluid pressure is selected to be sufficiently high enough to release the sliding piston 64 from the release collet 62, such as, by way of non-limiting example, approximately 1000 psi, the sliding piston 64 with attached first and second seals 66 and 68, respectively, is axially displaced within the piston section 42 in the direction generally indicated at 200. As the sliding piston 64 is displaced, fluid within the first piston retraction cavity 154 evacuates through the piston cavity relief bore 178 to the inner piston cavity 162, through the radial mandrel bores 180 to the central mandrel passage 146. Referring back to FIG. 5, the fluid then continues through the central mandrel passage 146 to the narrow end portion 94 in the control valve section 40, and into the central cavity 92 through the radial bore 108, axial bore 112, radial bore 110, and through the axial slots 128 of the shifting sleeve 50. The fluid may then exit the punch mechanism 30 through the radial bore 114.

Now referring to FIGS. 6 and 7, simultaneously, as the sliding piston 64 is displaced, fluid within the second piston retraction cavity 160 evacuates through the axial punch extension supply passage 244, pressurizing the plurality of punch extension cavities 240. As the plurality of punch extension cavities 240 are pressurized, the plurality of punches 72 are displaced within the plurality of punch sleeves 74, mechanically impacting the wellbore 10 or production tubing 18.

After the punches 72 are extended, an increased working pressure may be selected, increasing the pressure within the annular directing cavity 82. The annular ridge 122 is selected to have a greater cross sectional area than the annular ridge 126 so that a force difference may be formed therebetween. When a sufficiently high enough pressure is achieved, such as, by way of non-limiting example, approximately 3000 psi, a sufficient force is applied to the shifting sleeve 50 to overcome the compressive spring force of the compression spring 52. In particular, when the pressure gradient force between the annular directing cavity 82 and central cavity 92 exceeds the compressive spring force of the compression spring 52, the shifting sleeve 50 is displaced in the direction generally indicated at 202 in FIG. 5 to the second shifted position illustrated in FIG. 8.

When in the second shifted position, as illustrated in FIG. 8, the fluid passages are connected in a second configuration, such that the annular directing cavity 82, defined on either end by the annular ridges 122 and 126 on the shifting sleeve 50, is shifted and therefore the working fluid is no longer in fluidic communication with the annular piston extension cavity 86. In the second shifted position, the working fluid passes through the axial bore 80 to the annular directing cavity 82, through the radial bore 110, the axial bore 112, the radial bore 108, the narrow end portion 94 and into the central mandrel passage 146. As described above, the central mandrel passage 146 is in fluidic communication with the first piston retraction cavity 154 as well as with the plurality of punch retraction cavities 242. The increased working pressure therefore supplies pressure to return the sliding piston 64 to the first position as illustrated in FIG. 6, as well as to the plurality of punch retraction cavities 242, returning the plurality of punches 72 to the first position as illustrated in FIG. 6. As the plurality of punches 72 are returned to the first position, the fluid from the plurality of punch extension cavities 240 passes through the axial punch extension supply passage 244 to the second piston retraction cavity 160.

While the shifting sleeve 50 is in the second shifted position, the annular piston extension cavity 86 is no longer in fluidic communication with the working fluid, as described above. The annular piston extension cavity 86 is connected to the central cavity 92 through the axial bore 84, radial bore 83, and the central bore 138, and therefore in fluidic communication with the production section 16 through the radial bore 114. In such a way, as the sliding piston 64 is reset to the first position, the fluid within the annular piston extension cavity 86 may be evacuated from the punch mechanism 30.

When the sliding piston 64 and the plurality of punches 72 are reset to the first position, the working pressure may be reduced to such as, by way of non-limiting example, approximately 500 psi, thereby decreasing the pressure differential between the annular directing cavity 82 and the central cavity 92 such that the pressure gradient force is insufficient to overcome the compressive spring force of the compression spring 52, returning the compression spring 52 and the shifting sleeve 50 to the first position, as well. In this manner, the punch mechanism 30 can be engaged and reset for reuse within the wellbore 10 without the need to remove the work string 26, thereby increasing efficiency.

While specific embodiments of the invention have been described and illustrated, such embodiments should be considered illustrative of the invention only and not as limiting the invention as construed in accordance with the accompanying claims.

What is claimed is:

1. An apparatus for punching holes in a casing comprising:

an elongate tubular body extending between first and second ends and having a plurality of punches adapted to be selectably extended therefrom, said tubular body having a piston cavity therein, said first end of said tubular body being in fluidic communication with a pressurized fluid source;

a slidable piston contained within said cavity separating said cavity into extension and retraction cavities wherein said extension cavity is operable to pressurize a rear surface of said plurality of punches and said retraction cavity is operable to pressurize a front surface of said plurality of punches; and a valve assembly adapted to selectably connect said pressurized fluid source with said extension or retraction cavities so as to extend or retract said punches, said valve assembly comprising:

a longitudinally slidable sleeve forming an annular directing cavity with a valve cavity of said tubular body in fluidic communication with a fluid input extending to said first end of said tubular body being movable between first and second positions wherein said first position of said sleeve fluidically connects a fluid input path and said directing cavity to a first output extending to said extension cavity and said second position connects said fluid input channel and said directing cavity to a second output path extending to said retraction cavity.

2. The apparatus of claim 1 wherein said sleeve is biased to said first position.

3. The apparatus of claim 2 wherein said sleeve is biased to said first position by a spring.

4. The apparatus of claim 1 wherein said sleeve includes first and second annular walls extending to a sealed contact with said valve cavity defining said directing cavity therebetween.

5. The apparatus of claim 4 wherein said first annular wall has a greater height and said second annular wall so as to bias said sleeve towards said second position under pressure from said fluid source.

6. The apparatus of claim 1 wherein said sleeve includes flexible fingers extending therefrom adapted to be selectably engageable within annular detents in said valve cavity at said first and second positions.

7. The apparatus of claim 1 wherein said sleeve forms a vent chamber with said valve chamber.

8. The apparatus of claim 7 wherein said vent chamber is vented to an exterior of said tubular body.

9. The apparatus of claim 8 wherein said vent chamber is selectably in fluidic communication with an opposite of said first or second flow paths that is in communication with said fluid input.

10. The apparatus of claim 1 wherein said piston is selectably retained at an initial position towards said extension cavity when said plurality of punches are retracted.

11. The apparatus of claim 10 wherein said piston is retained at said initial position by biased arms selectably engaged within an annular groove.

12. The apparatus of claim 10 wherein said piston forms a second piston extension chamber with said tubular body separate from said extension chamber wherein said extension chamber is vented to an exterior of said tubular body as said piston is moved in a direction of said extension chamber.

13. The apparatus of claim 1 wherein said pressurized fluid is directed through a mandrel extending through said piston to said front surfaces of said plurality of punches at said second position of said sleeve.

14. The apparatus of claim 1 wherein said plurality of punches extend and retract along radial paths from said tubular body.

15. The apparatus of claim 14 wherein said plurality of punches are contained within said tubular body at a retracted position.

16. A method of punching holes in a casing comprising:

locating an elongate tubular body within a wellbore at a desired location, said elongate tubular body extending between first and second ends having a plurality of punches adapted to be selectably extended therefrom, said tubular body having a piston cavity therein;

pressurizing a first end of said elongate tubular body with a pressurized fluid source; and directing said pressurized fluid to an extension side of a piston located within said cavity with a valve assembly adapted to selectably connect said pressurized fluid source with said extension or retraction cavities so as to extend or retract said punches;

a valve assembly comprising:

a longitudinally slidable sleeve forming an annular directing cavity with a valve cavity of said tubular body in fluidic communication with a fluid input extending to said first end of said tubular body being movable between first and second positions wherein said first position of said sleeve fluidically connects a fluid input path and said directing cavity to a first output extending to said extension cavity and said second position connects said fluid input channel and said directing cavity to a second output path extending to said retraction cavity.

* * * * *